US006647552B1

(12) United States Patent
Hogan

(10) Patent No.: US 6,647,552 B1
(45) Date of Patent: Nov. 18, 2003

(54) MEDICAL DIGNITY GARMENT

(75) Inventor: Mary M. Hogan, Morris, IL (US)

(73) Assignee: Guided Inspiration, Inc., Morris, IL (US)

( * ) Notice: Subject to any disclaimer, the term of this patent is extended or adjusted under 35 U.S.C. 154(b) by 0 days.

(21) Appl. No.: 10/358,527

(22) Filed: Feb. 5, 2003

(51) Int. Cl.[7] ..... A41D 13/00
(52) U.S. Cl. ..... 2/114; 2/69
(58) Field of Search ..... 2/114, 115, 113, 2/69, 227, 228, 238, 79, 400, 403, 406, 108, 102, 104, 105, 106, 85, 80, 83, 93, 94, 95, 96, 244, 246, 247–251; 604/174, 179, 345, 344, 343; 600/388–390; 128/DIG. 26, 873–877

(56) References Cited

U.S. PATENT DOCUMENTS

| | | | | | |
|---|---|---|---|---|---|
| 302,901 | A | | 8/1884 | Fenne | |
| 1,462,515 | A | * | 7/1923 | McElroy | 2/114 |
| 1,489,046 | A | | 4/1924 | Thompson | |
| 1,998,051 | A | | 4/1935 | Gerber | |
| 3,276,036 | A | * | 10/1966 | Cater | 2/114 |
| 4,383,335 | A | | 5/1983 | Slocum | |
| 4,718,124 | A | | 1/1988 | Sawicki et al. | |
| 4,759,083 | A | | 7/1988 | Belcher | |
| D305,700 | S | | 1/1990 | Werner | |
| 4,920,578 | A | | 5/1990 | Janzen et al. | |
| 4,930,161 | A | | 6/1990 | Cohen | |
| 4,964,173 | A | | 10/1990 | Gordon et al. | |
| 5,048,122 | A | | 9/1991 | Prieur | |
| 5,097,536 | A | | 3/1992 | Cohen | |
| 5,133,086 | A | | 7/1992 | Truitt et al. | |
| 5,142,702 | A | | 9/1992 | Piloian | |
| D332,342 | S | | 1/1993 | Dye et al. | |
| D336,968 | S | | 7/1993 | Russano | |
| 5,257,956 | A | | 11/1993 | Ewen | |
| 5,341,515 | A | | 8/1994 | Cohen | |
| D359,837 | S | | 7/1995 | Brannon | |
| 5,440,763 | A | | 8/1995 | Shah | |
| 5,553,323 | A | * | 9/1996 | Chou et al. | 2/114 |
| 5,564,123 | A | * | 10/1996 | Grassick | 2/69 |
| 5,887,279 | A | | 3/1999 | Elting et al. | |
| D408,117 | S | | 4/1999 | Wade | |
| 6,032,289 | A | * | 3/2000 | Villapiano | 2/102 |
| 6,216,270 | B1 | | 4/2001 | Moquin et al. | |
| D463,093 | S | | 9/2002 | Murray | |
| 6,460,187 | B1 | | 10/2002 | Siegel | |
| 6,460,188 | B1 | | 10/2002 | Hatton | |
| 6,484,321 | B1 | | 11/2002 | Shamam | |

OTHER PUBLICATIONS

Duty of Candor and Disclosure Under 37 C.F.R. 1.56(b), signed by Mary M. Hogan, dated Jan. 26, 2003.

* cited by examiner

*Primary Examiner*—Gloria M. Hale
(74) *Attorney, Agent, or Firm*—McKee, Voorhees & Sease, P.L.C.

(57) ABSTRACT

The invention comprises a medical dignity garment with a body portion with a back panel and opposing front panel, a pair of sleeves attached to the body portion and a flap on one of the front panels moveable between open and closed positions relative to a patient's medical access area. The invention also comprises a flap having a horizontal edge extending substantially horizontally above a patient's breast and being releaseably fastened to the one front panel, the flap having a folding edge fixed to the back panel so that the flap is movable upwardly from the closed position to the open position so as to provide access to the patient's medical access area without removing the garment.

10 Claims, 4 Drawing Sheets

MEDICAL DIGNITY GARMENT

BACKGROUND OF THE INVENTION

When adults and children need frequent medical treatment they may have a designated area specified for medical treatment. A medical access area may be for but is not limited to access to a central line for administration of medical treatment, access to an ostomy, access to an irradiation portal, access to an operative site for treatment and inspection, and access to wires, such as diagnostic wires, that transverse the skin. These medical access areas may be located upon a patient in a position which compromises the patient's comfort and dignity. Therefore, there exists a need for apparel to be designed with openings designed to be located over a medical access area for any percutaneous or transcutaneous diagnostic or therapeutic procedures but maintains the patient's dignity and comfort.

When adults and children need frequent medical treatment intravenous medicines, blood products and blood draws, it becomes more difficult as time progresses to find a usable vein. To improve medical care and reduce pain a "central venous access line" or "central line" is placed in the patient. Central lines are a relatively new concept and has been used for only the past few decades. Recently central lines have become commonly used and popular in hospitals.

A central line is typically placed in the upper chest, abdomen or groin. The central line is a permanent intravenous tube or catheter which can stay in place as long as it is needed. There are two main types of central lines. One type is entirely under the skin (an "interna" line and the other has tubing outside the skin (an "external" line). Both have a long thin tube that reaches the large vein that goes to the heart.

Internal central lines cannot be seen once they are under the skin. An example of this type of central line is the PORT-A-CATH ® and PORT-A-CATH II. A further example would be a urinary catheter. The internal line is placed in the chest by a surgeon in the operating room while the patient is under general anesthesia. In order to use the internal line, a needle is put through the patient's skin, causing some pain, and into a reservoir. External central lines have tubing outside the skin. In order to use the external line, a needle is placed through the end of the tubing, without causing pain to the patient, and into a reservoir.

Medical treatment programs employing central lines at a medical access areas can last up to several years. The patient must transfer a portion of his or her personal power to the medical professionals when undergoing such care. Therefore, it is a primary objective of the present invention to produce a garment which provides access to the medical access area without compromising the patient's personal power.

Treatment facilities are typically filled with patients in close proximity to one another. Often there is no wall or curtain available to provide privacy. Medical professionals may aspire to provide privacy in these situations yet much improvement is warranted. Therefore, a further objective of the present invention is to provide a garment which may aid the medical professional in providing privacy to the individual receiving treatment.

Specialty institutional garments could improve the privacy situation. However, laundering within the treatment facilities typically has limited sorting procedures to control the return of specialty garments to the needed treatment locations, thus surrendering the specialty garments intended usefulness. Therefore, it is a still further objective of the present invention to provide the patient with a personal garment that may be used both upon the "street" and within the treatment location.

Ready-made garments are typically pulled up and away exposing large areas of skin and also the medical access area. When the garments are pulled up and away, they are often bunched-up in uncomfortable positions. With treatment through the medical access area that can last several hours, the patient may be physically uncomfortable, emotionally uncomfortable, and desire to move about freely. Indeed, many treatment centers promote physical movement during treatment to maintain a healthy lifestyle. Therefore, a still further objective of the present invention is to provide a garment which does not require bunching up clothing in uncomfortable positions and allows the patient to move about freely while receiving medical treatment through a medical access area.

In the prior art, there are garments that may allow access to the upper chest or lower chest; however, these are unsuitable because they expose a larger area of the body than necessary to expose a medical access area and are unsuitably worn as "street clothes." The multi-purpose gown issued to Shah et al., U.S. Pat. No. 5,440,763 involves a hospital garment for access to the chest region, completely exposing the breast. U.S. Pat. No. 302,901 issued to Fenne is a garment for the bed ridden and the flaps are arranged to take measurements of the patient's heart and respiratory functions. The '901 patent primarily discloses a garment for use in an invalid who cannot function without the aid of others. Therefore, a still further objective of the present invention is to provide a garment which only exposes an area about the medical access area and allows the patient to incorporate treatment into their daily routines without dressing concerns.

In the prior art, there are also garments that allow access to a central line. U.S. Pat. No. 6,477,710 B1 issued to Ojoyeyi discloses a garment for concealing a medical appliance behind pocket structures of children's clothing. Therefore, a still further objective of the present invention is to provide a garment which conceals a central line and the medical access area behind flap structures of either children's clothing or adult clothing.

These and other more detailed and specific objectives of the present invention will be better understood by reference to the following figures and detailed description of the preferred embodiment which illustrate by way of example but a few of the various forms of the invention within the scope of the claims.

BRIEF SUMMARY OF THE INVENTION

The medical dignity garments of the present invention are manufactured to facilitate easy on and off of the natural appendages. The present invention garments are designed to support a healthy, life-giving image for people and provide modesty to the level desired personally and culturally. Patients using this invention while undergoing medical treatment through a medical access area can re-establish their desired level of modesty during medical treatment and wear stylish clothes that support a healthy, life-giving image.

Medical dignity garments are designed with openings that allow caregivers and medical professionals access to the medical access areas with no physical or emotional discomfort to the patient. The typical location sites on the body for the variety of medical access areas are located on the upper chest above the breast, in the abdomen below the breast, and about the groin area. The present invention removes the discomforts and hazards associated with wearing ready-made garments. In the present invention, there are access locations in either an individual side of the garment or on both sides of the garment located about the typical location sites of the medical access area.

The present invention also provides for garments to be fitted with pockets. These pockets would be filled with treatment devices such as pumps or tubing for those patients whose life requires continuous treatment through the medical access area.

Through the access openings in the present invention, the caregivers and medical personnel expose the minimum skin required for cleaning and treatment. With the present invention, the modesty and dignity of the patient is not jeopardized. Furthermore, the patient is not emotionally traumatized. The medical dignity garment allows the patient's dignity to be maintained at the highest level possible. Using the present invention, patients can move about their daily routine with their medical access areas and treatment devices being concealed.

In the present invention, access openings are designed with patient comfort in mind. Ready-made garments typically need to be pulled up and away exposing large areas of skin and bunched up in uncomfortable positions. Using the medical dignity garment, treatment may be administered to a patient by simply removing a flap over the medical access area, treatment administered, and the flap again closed over with a fastener. With this procedure, the patient is then fully dressed and can move about freely as is often recommended by the medical staff.

The medical dignity garments are designed with styles compatible to the ready-made industry. Having ready-made garments supports a healthy, life-giving self-image. The medical dignity garments emphasize their similarities with the popular culture as opposed to the isolation associated with being an individual battling a life-threatening disease.

The present invention also facilitates easy on and off of the natural appendages, such as arms and legs, as the patient is receiving treatment. The medical dignity garments also allow the patients to include treatment in their daily routine without worrying how their ready-made clothing may discomfort their treatment. In summary, the present invention allows for an individual to seek medical treatment without changing their clothes.

DETAILED DESCRIPTION OF THE PREFERRED EMBODIMENT

Figure 1:
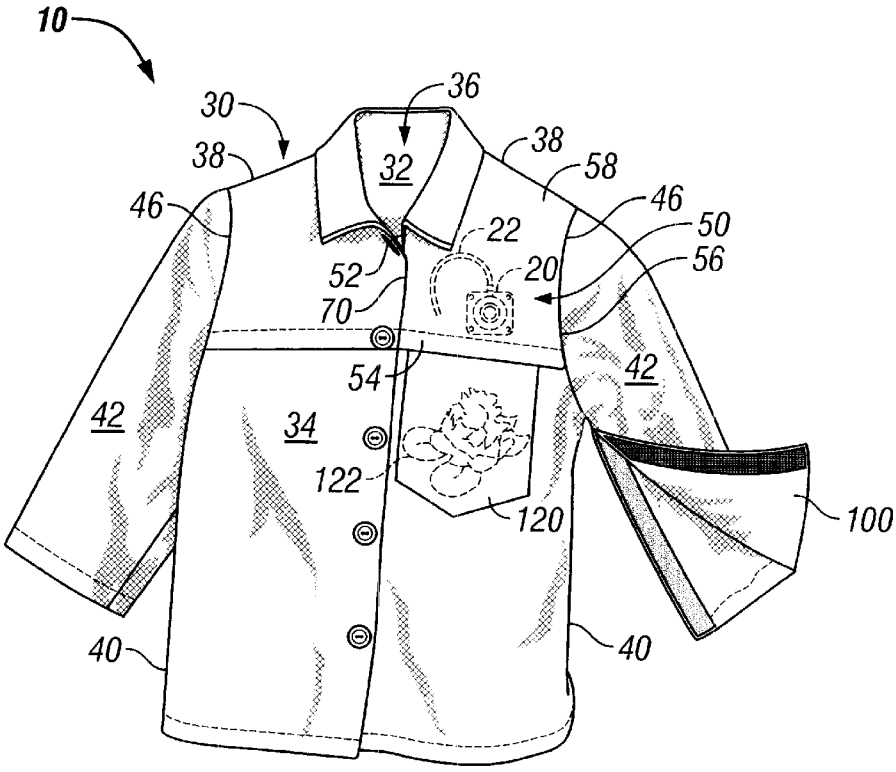
FIG. 1 is a medical dignity garment wherein the body portion is a shirt with a flap adapted for access to a medical access area located in the upper chest of the patient.

As seen in FIG. 1 a medical dignity garment 10 is disclosed. The medical dignity garment 10 is adapted for use with a medical access area or central line 20. The central line 20 may have attached to it central line tubing 22.

Figure 2:
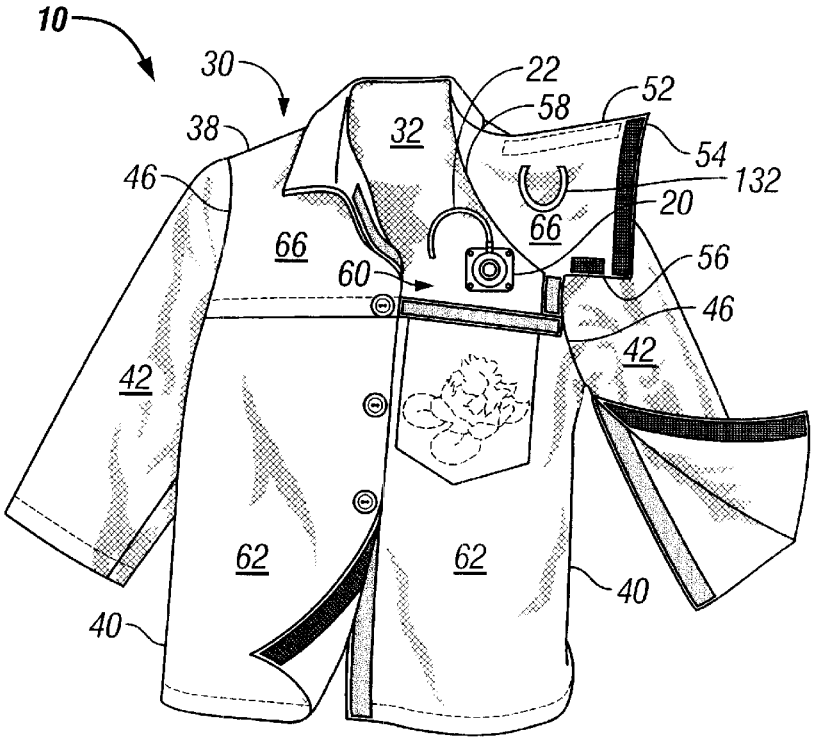
FIG. 2 is the medical dignity garment of FIG. 1 showing the flap in an opened state adapted for the exposing the medical access area.

As seen in FIG. 1 and FIG. 2, the medical dignity garment 10 has a body portion 30. The body portion 30 has a back panel 32 and opposing front panels 34 connected by shoulder seams 38 and side seams 40. The body portion 30 has opposing sleeves 42 attached by arm hole seams 46. The body portion 30 defines a neck opening 48.

The front panels have at least one flap 50. The flap being defined by placket edge or zipper edge 52, lower edge or horizontal edge 54, sleeve edge or vertical edge 56, and upper edge or folding edge 58. The flap 50 is detachable from the edges and foldable along the folding edge 58.

The front panels 34 have a placket overlap area 70 defining the placket edge 52 of the flap 50. The front panels 34 at this point being connected by a set of first fasteners. The fasteners, preferably made of non-metal radiation penetrable, may be any suitable attachment such as hook and loop tape (for instances, "Velcro"@), snaps, buttons, zippers or the like.

The front panels have at least one upper section 66 and one lower section 62. The upper and lower sections 66, 62 have an approximately horizontal overlap area 80 above the breast defining the lower edge 54 of the flap 50. The upper and lower sections 66, 62 are connected by a set of second fasteners 82. The fasteners, preferably made of non-metal radiation penetrable, may be any suitable attachment such as hook and loop tape, snaps, buttons, zippers or the like.

The front panels 54 have at least one sleeve overlap or vertical overlap area 90. The sleeve overlap area 90 is defined by the upper section 66 and the sleeve 42. The sleeve overlap area 90 defines the sleeve edge 56 of the flap 50. The upper section 66 is connected to the sleeve 42 by a set of third fasteners 92. The fasteners, preferably made of non-metal radiation penetrable, may be any suitable attachment such as hook and loop tape, snaps, buttons, zippers or the like.

As seen in FIGS. 1 and 2, the medical dignity garment 10 may have sleeves 42 that are adapted for intravenous treatment or other medical treatment given to the patient. As such, the medical dignity garment 10 may have a sleeve 42 that has a segment 100 adapted for providing access to the patient's arm.

In one embodiment, the sleeve 42 has this segment 100 comprising a lengthwise sleeve slit 102 connected by a set of fourth fasteners 104. The fasteners, preferably made of non-metal radiation penetrable, may be any suitable attachment such as hook and loop tape, snaps, buttons, zippers or the like. The lengthwise sleeve slit 102 permits separation of the sleeve 42 into the segment 100.

Figure 3:
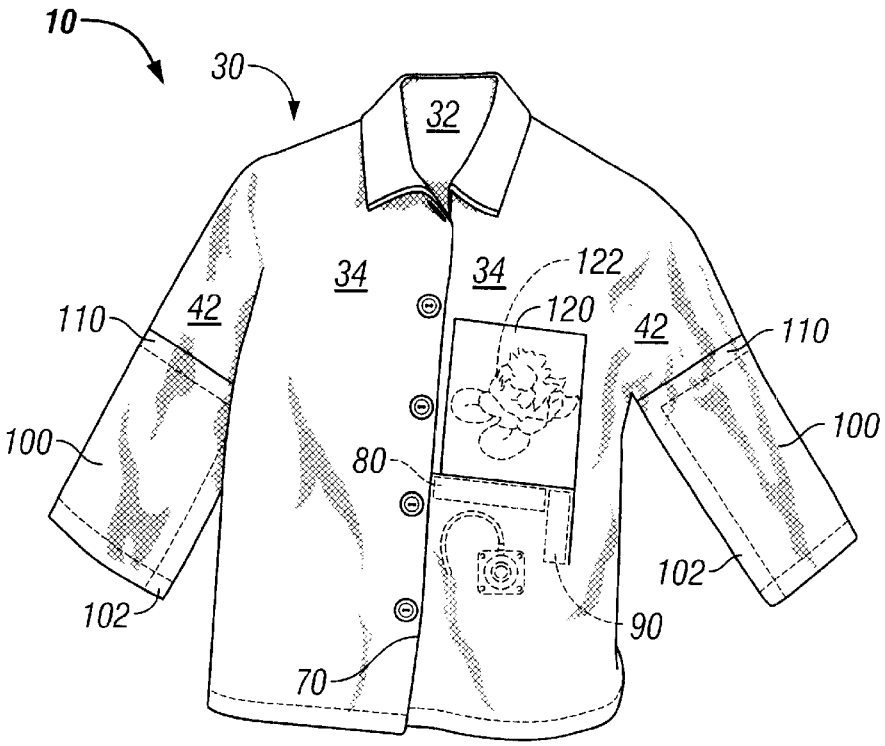
FIG. 3 is a medical dignity garment wherein the body portion is a shirt with a flap adapted for access to a medical access area located below the breast of the patient.
Figure 4:
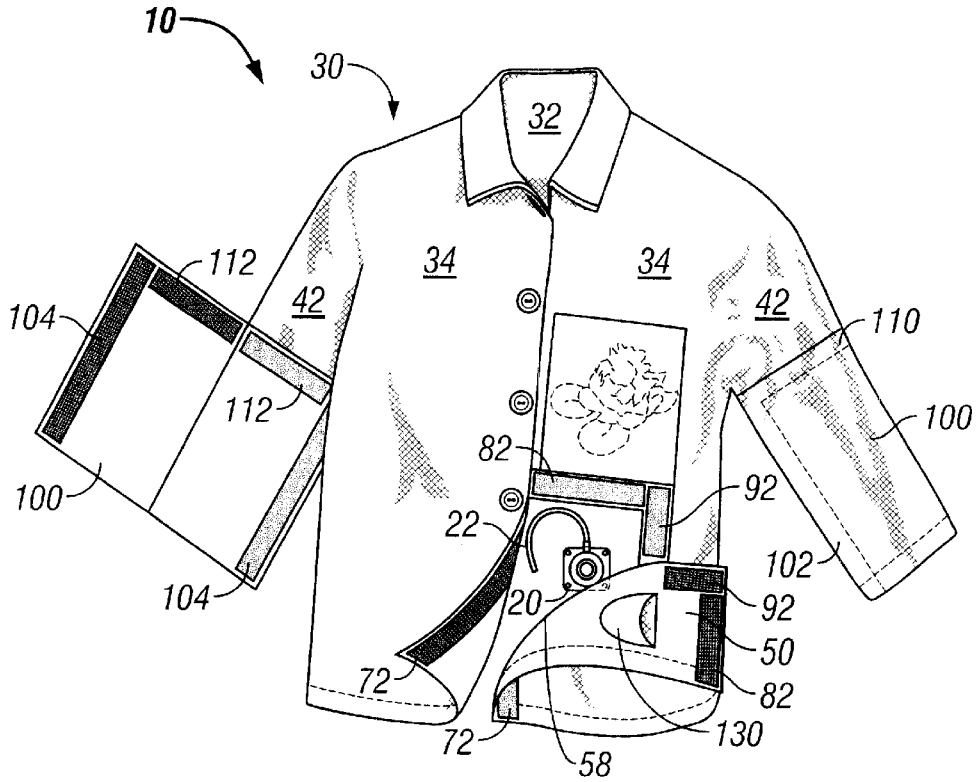
FIG. 4 is the medical dignity garment of FIG. 3 showing the flap in an opened state adapted for exposing the medical access area.

In another embodiment as seen in FIGS. 3 and 4, the sleeves comprise a widthwise sleeve slit 110 connected by a set of fifth fasteners. The fasteners, preferably made of non-metal radiation penetrable, may be any suitable attachment such as hook and loop tape, snaps, buttons, zippers or the like. The widthwise sleeve slit 110 permits separation of the sleeve into the segment 100. In this embodiment, the segment 100 appears in the form of an approximately rectangular opening.

The medical dignity garment 10 may have a flap seam edge following along the arm hole seam 46. By having the flap seam edge follow this path, the sleeve edge 56 is disguised along the arm hole seam 46. This orientation helps to disguises the access opening 60 from people who are unfamiliar that the patient may be receiving medical treatment.

The flap as referred to in FIGS. 1, 2, 3, 4, 5 and 6 is adapted for location over a medical access area for any percutaneous or transcutaneous diagnostic procedures but maintains the patient's dignity and comfort. Alternatively, the flap is adapted for location over a medical access area for any percutaneous or transcutaneous therapeutic procedures but maintains the patient's dignity and comfort. Still alternatively, the flap is adapted for location over a medical access area for other medical procedures well known in the art but maintains the patient's dignity and comfort.

As seen FIGS. 1, 2, 3, and 4, the medical dignity garment 10 may also have at least one section upon the front panel below the flap lower edge 54 or above the flap horizontal edge 54 adapted for disguising the flap 50. In one form, the front panel 34 may have a pocket serving as the disguising section 120. In another form, the disguising section 120 may be a decorative emblem 122 serving as the disguising section 120. In yet another form, the front panel 34 may have both a disguising section 120 and a decorative emblem 122.

Added features may be placed upon the medical dignity garment 10 to include an interior pocket 130 on the front panel 34 for storing medical access area tubing or central line tubing 22.

Also anticipated is the insertion of a loop 132 on the front panel for securing central line tubing 22.

Alternate embodiments may be seen in FIG. 3 and FIG. 4. In this embodiment the medical dignity garment 10 has a body portion 30 with a back panel 32 and opposing front panel, 34. The medical dignity garment 10 in this embodiment is a shirt; thus, a pair of sleeves is attached to the body portion 30. The flap 50, in this embodiment, is on at least one of the front panels and moveable between the open and closed position relative to a patient's medical access area 20.

In these embodiments, the flap 50 has a horizontal edge 54 extending substantially horizontally below a patient's breast and being releaseably fastened to the front panel 34. The flap 50 has a folding edge 58 fixed to the front panel 34. The flap 50, in this position, is moveable downwardly from the closed position to the open position so as to provide access to the patient's medical access area 20 without removing the garment.

Although the embodiment in FIG. 3 and FIG. 4 is similar to the preferred embodiment, it differs in that it is positioned below the patient's breast.

Figure 5:
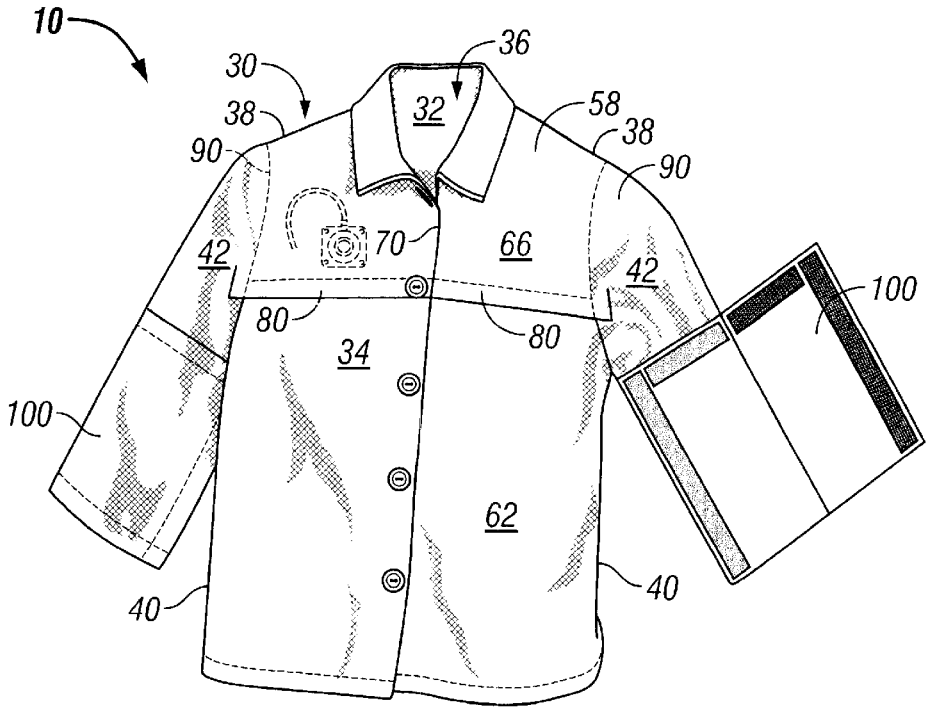
FIG. 5 is a medical dignity garment wherein the body portion is a shirt with flaps on both the left and right side of a patient adapted for access to a medical access area located in the upper chest of the patient.
Figure 6:
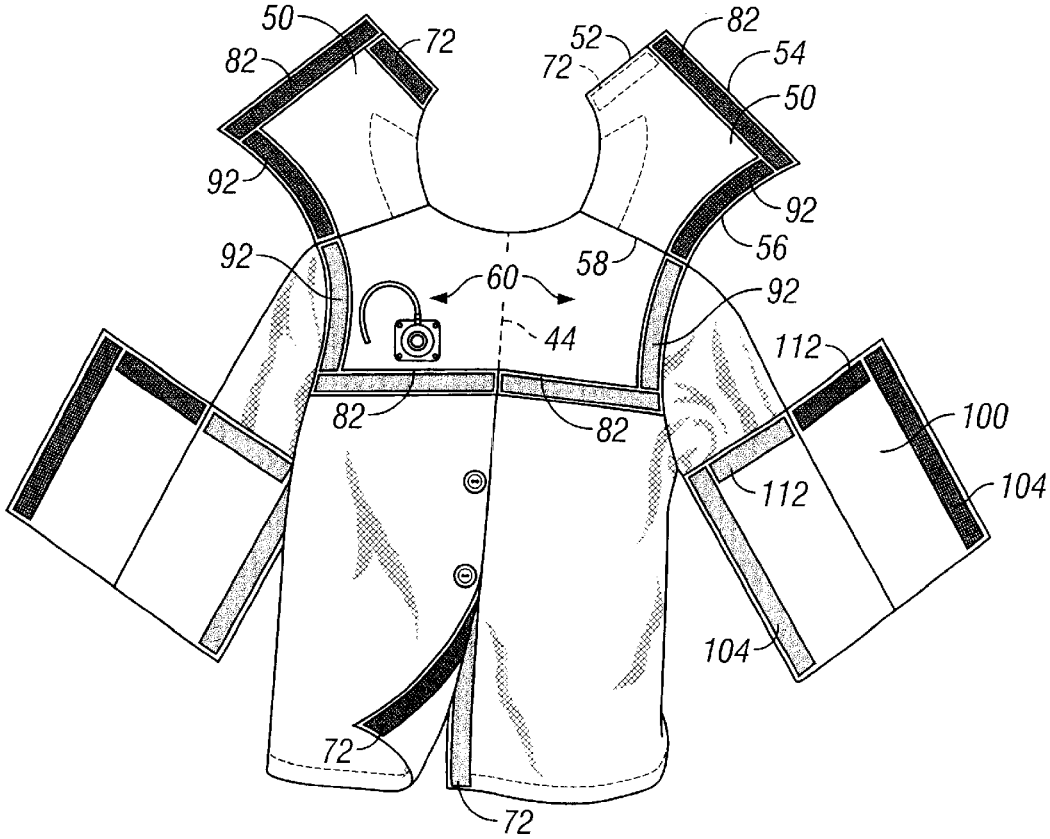
FIG. 6 is the medical dignity garment of FIG. 5 showing the flaps in an open state exposing the medical access area.

FIGS. 5 and 6 illustrate a further embodiment of the present invention. In this embodiment flaps 50 are located on both opposing front panels 34. This embodiment is particularly useful if there is a patient who has medical access areas 20 on both sides. This embodiment is also useful if the medical professional is undecided as to which side to place the medical access area 20. This embodiment is also useful to a patient who may have a medical access area surgically placed on one side and later have the medical access area placed on the opposing side. This embodiment is also useful to a patient who purchases the garment prior to having the medical access area surgically placed.

It is also anticipated that along the placket edge 52 there will be a centerline piece (not shown) that extends up from the lower section 62 along the garment front centerline 44 to the neck. At this point, the flaps may attach to the point as it runs up along the neck through the centerline 44 of the body. Advantages of this orientation include greater clothing stability.

Figure 7:
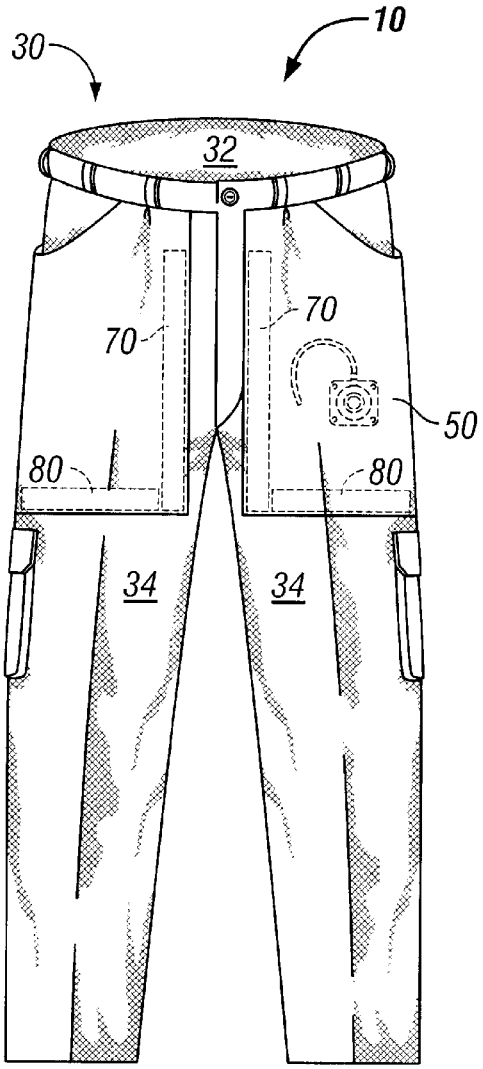
FIG. 7 is a medical dignity garment wherein the body portion is a pair of pants with a flap adapted for access to a medical access area located in the groin area of the patient.
Figure 8:
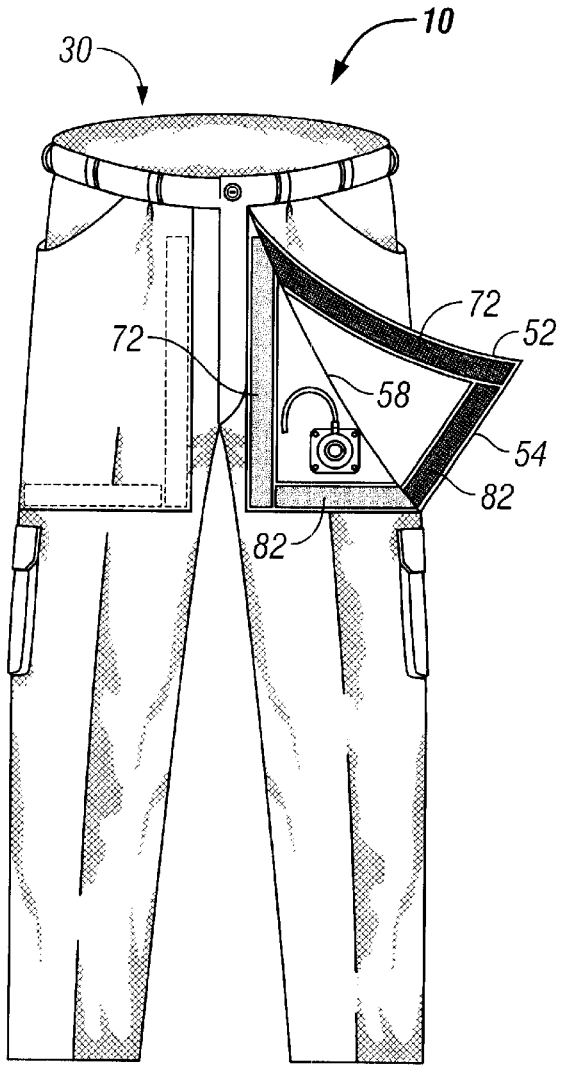
FIG. 8 is the medical dignity garment of FIG. 7 showing the flap in an open state.

As seen in FIGS. 7 and 8, the medical dignity garment 10 may take the form of a pair of pants. In this embodiment the medical dignity garment has a body portion 30 with a back panel 32 and opposing front panels 34. The embodiment has a flap on one of the front panels that is moveable between a open and closed position relative to the patient's medical access area. The flap 50 is located to have a horizontal edge 54 extending substantially horizontally amid the patient's thigh and being releaseably fastened to the front panel 34. The flap 50 has a folding edge 58 affixed to the front panel 34 so that the flap is moveable upperwardly from the closed position to the open position so as to provide access to the patient's medical access area 20 without removing the garment 10.

In use, the patient wears the medical dignity garment 10 to the hospital. The garment 10 is unrecognizable to the public eye as being a clothing which further the medical treatment within the hospital. Once the patient is within the hospital and the patient is ready for medical treatment, the patient has the flap opened by medical personnel exposing a significant area around a medical access area for the purpose of sanitizing and preparing the area for medical treatment.

The medical personnel then inserts chemotherapy drugs, intravenous solution, or an assortment of other fluids into the patient which may have medical purposes and are known in the art. Once the treatment has begun administering, the medical personnel may close the flap over the individual. The flap conceals the medical treatment being done underneath the flap.

Once treatment is finished the medical personnel will then open the flap and remove any device which is attached to the medical access area 20.

In the drawings and specification there has been set forth the preferred embodiment of the invention, and although specific terms are employed, these are used in a generic descriptive sense only and not for purposes of limitation. Change in the form and proportion of parts as well as in the substitution of equivalents are contemplated as circumstances may suggest without departing from the spirit or scope of the invention in the following claims.

What is claimed is:

1. A medical dignity garment allowing access to a medical access area in a patient without removal of the garment and closure over the medical access area while treatment is in progress, the medical dignity garment comprising:

the body portion having a back panel and opposing front panels connected by shoulder and side seams;

a body portion having opposing sleeves attached by a arm hole seam;

the body portion defining a neck opening;

the front panels having at least one flap, the flap being defined by placket, lower, sleeve, and folding edges, the flap detachable and foldable along the folding edge;

the front panels having a placket overlap area defining the placket edge of the flap, the panels being connected by a set of first fasteners;

the front panels having at least one upper and lower section, the upper and lower section having an approximately horizontal overlap area above the breast defining the lower edge of the flap, the upper and lower sections being connected by a set of second fasteners;

the front panels having at least one sleeve overlap area defined by the upper section and sleeve, the sleeve overlap area defining the sleeve edge of the flap, the upper section and sleeve being connected by a set of third fasteners.

2. The medical dignity garment of claim 1, wherein the sleeves have a segment adapted for providing access to a patient arm.

3. The medical dignity garment of claim 2, wherein the sleeves further comprises a lengthwise sleeve slit connected by a set of fourth fasteners, the lengthwise sleeve slit permitting separation of the sleeve into the segment.

4. The medical dignity garment of claim 3, wherein the sleeves further comprises a widthwise sleeve slit connected by a set of fifth fasteners, the widthwise sleeve slit permitting separation of the sleeve into the segment.

5. The medical dignity garment of claim 1, wherein the flap sleeve edge follows along the arm hole seam disguising the flap.

6. The medical dignity garment of claim 1, further comprising at least one section upon the front panel below the flap lower edge adapted for disguising the flap.

7. The medical dignity garment of claim 6, wherein the section is a pocket.

8. The medical dignity garment of claim 6, wherein the section is a decorative emblem.

9. The medical dignity garment of claim 1, further comprising at least one interior pocket on the front panel for storing medical access area tubing.

10. The medical dignity garment of claim 1, further comprising at least one loop on the front panel for securing medical access area tubing.

* * * * *